United States Patent [19]

Elliott

[11] 3,983,273

[45] Sept. 28, 1976

[54] CARDING MACHINES

[75] Inventor: Gordon Henry Elliott, Bridgwater, England

[73] Assignee: Bonded Fibre Fabric Limited, Bridgewater, England

[22] Filed: May 2, 1974

[21] Appl. No.: 466,453

[30] Foreign Application Priority Data

| | | |
|---|---|---|
| May 9, 1973 | United Kingdom | 22241/73 |
| Oct. 4, 1973 | United Kingdom | 46445/73 |
| Dec. 17, 1973 | United Kingdom | 58421/73 |

[52] U.S. Cl. ..... 427/430; 19/99; 19/106 R

[51] Int. Cl.[2] ..... B05D 3/00

[58] Field of Search ..... 19/98, 99, 100, 101, 19/105, 106 R, 155; 156/62.2; 427/430

[56] References Cited

UNITED STATES PATENTS

| | | | |
|---|---|---|---|
| 1,833,811 | 11/1931 | Allen et al. | 19/106 R |
| 1,880,670 | 10/1932 | Bates | 19/99 |
| 2,055,411 | 9/1936 | Hurst | 19/155 |
| 2,987,779 | 6/1961 | Kawashima | 19/106 R |
| 3,051,996 | 9/1962 | Varga | 19/99 |
| 3,119,152 | 1/1964 | Kalwaites | 19/106 R |

FOREIGN PATENTS OR APPLICATIONS

| | | | |
|---|---|---|---|
| 1,138,108 | 1/1957 | France | 19/99 |
| 147,493 | 3/1902 | Germany | 19/106 R |
| 285 | 1879 | United Kingdom | 19/99 |
| 4,578 | 1878 | United Kingdom | 19/100 |
| 1,104,682 | 2/1968 | United Kingdom | 19/99 |

*Primary Examiner*—Dorsey Newton
*Attorney, Agent, or Firm*—Watson, Cole, Grindle & Watson

[57] ABSTRACT

A carding machine for forming a fibrous web from textile fibers comprises at least three carding cylinders arranged in succession with worker means for working fibers progressively from cylinder to cylinder, means for rotating the cylinders at successively increasing peripheral speeds in the direction of travel of the fibers, a doffer in working relationship with the last cylinder for receiving the fibers, a means for rotating the doffer at a peripheral speed less than the peripheral speed of the last carding cylinder, the last carding cylinder being rotatable at such a peripheral speed that fibers are projected from the last carding cylinder to the doffer and the doffer being placed sufficiently close to the penultimate carding cylinder without being in working relationship thereto that air flow between the penultimate carding cylinder and the doffer is restricted so that in operation a stream of air flowing with the fibers from the last carding cylinder towards the doffer meets with resistance.

8 Claims, 6 Drawing Figures

Figure 1:
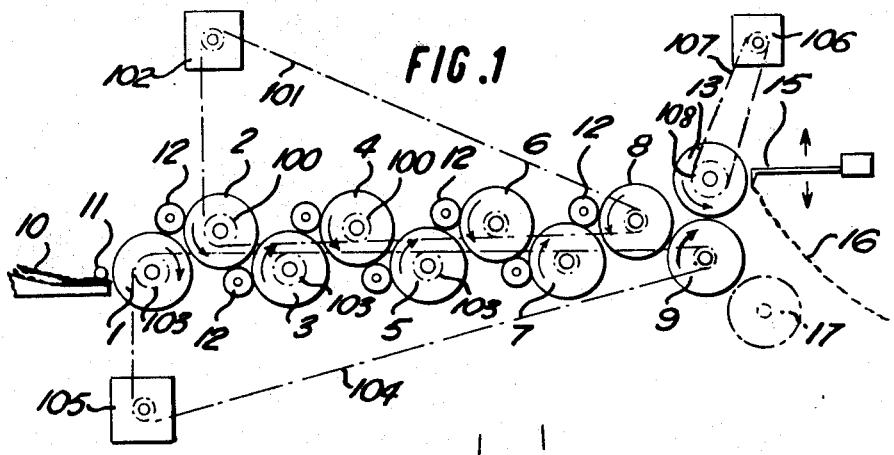

102
101
107
106
13
15
108
12
2
100
4
100
12
6
12
8
10
11
16
1
103
12
3
103
5
103
7
9
17
105
104

107
13
108
15
101
8
14
100
7
103
104
9
16

106
107
108
13
18
8
14
101
109
7
100
103
9
103
104

CARDING MACHINES

This invention relates to carding machineswith particular application to roller train carding machines and to means for increasing the transverse direction strength of fibrous webs produced by such machines.

A roller train carding machine conventionally comprises a series of carding cylinders of substantially the same diameter placed in succession in working relationship with each other and rotated in incrementally increased speeds from a feed end to a delivery end. Textile fibres introduced as a lap or mat of fibers at the feed end of the train are forwarded and processed from one carding cylinder to the next assisted by worker rollers placed between each pair of carding cylinders and in working relationship with each. At the delivery end of the train, fibres are received from the last carding cylinder by a doffer, and a coherent web is removed from the doffer by a conventional oscillating comb or by a roller doffer. The coherent web consists of predominantly parallelised fibres lying in the longitudinal direction. Such webs are commonly impregnated with bonding agents, such as an acrylic copolymer latex to form non-woven fabrics.

Since the fibres are predominantly parallelised in the longitudinal direction, the web and any non-woven fabrics manufactured therefrom are much weaker in strength in the transverse direction than in the longitudinal direction. For example, such a non-woven fabric has a transverse strength about one tenth the strength in the longitudinal direction.

In order to achieve fibrous webs of improved strength in the transverse direction it has been the practice to lap one or more webs delivered from carding machines diagonally or cross-wise to obtain a composite web with more uniform strengths in the longitudinal, and transverse directions. Such lapping requires the provision of special mechanisms and gives rise to difficulties in obtaining suitable light weight webs free of irregularities and visible faults. Other efforts to achieve improved transverse strength in carded webs have been directed to rearranging webs already substantially formed in sheet form on carding machines to form tangled structures.

This invention is concerned with a carding machine which produces coherent webs of fibres having improved strength in the transverse direction.

According to the present invention a carding machine for forming a fibrous web from textile fibres comprises at least three carding cylinders arranged in succession with worker means for working fibres progressively from cylinder to cylinder, means for rotating the cylinders at successively increasing peripheral speeds in the direction of travel of the fibres, a doffer in working relationship with the last cylinder for receiving the fibres, a means for rotating the doffer at a peripheral speed less than the peripheral speed of the last carding cylinder, the last carding cylinder being rotatable at such a peripheral speed that fibres are projected from the last carding cylinder to the doffer and the doffer being placed sufficiently close to the penultimate carding cylinder without being in working relationship thereto that air flow between the penultimate carding cylinder and the doffer is restricted so that in operation a stream of air flowing with the fibres from the last carding cylinder towards the doffer meets with resistance.

By means of the carding machine of the present invention a coherent web of fibers is obtained having an increased strength in the transverse direction when compared with that of a web produced by a conventional carding machine in which the doffer is placed remote from the penultimate carding cylinder.

The spacing between the doffer and the penultimate carding cylinder should preferably be not less than about 17 thousandths of an inch and preferably not less than about 20 thousandths of an inch otherwise there is a tendency for fibres to be picked up from the penultimate carding cylinder by the doffer. On the other hand the spacing between the doffer and the penultimate carding cylinder should preferably not exceed about 500 thousandths or more preferably 200 thousandths of an inch since the increase in transverse strength of the web diminishes as the restriction to the air flow between the cylinder and doffer decreases. An optimum spacing is about 30 thousandths of an inch.

In a preferred form of the invention, one further doffer or a train of two or more further doffers is placed in working relationship with the doffer with means for rotating each further doffer at a peripheral speed less than the preceding doffer or further doffer.

The invention also includes a process for forming a fibrous web comprising feeding textile fibres to the feed end of a carding machine including at least three carding cylinders arranged in succession and rotated at incrementally increased peripheral speeds, working the fibres from carding cylinder to carding cylinder towards a web delivery end of the machine, rotating the last carding cylinder at such a peripheral speed that fibres carried by it fly to a doffer, rotating the doffer at a peripheral speed less than the peripheral speed of the last carding cylinder and maintaining the doffer sufficiently close to the penultimate carding cylinder without being in working relationship thereto that air flow between the doffer and the penultimate carding cylinder is restricted so that a stream of air flowing with the fibres from the last carding cylinder towards the doffer meets with resistance.

Since the doffer is rotated at a slower peripheral speed than the last carding cylinder which may be up to one hundredth the speed of the last carding cylinder, the fibres arriving at the doffer are pushed up together to form a web. In conventional carding machines these fibres are orientated predominantly in the direction of travel with a minor proportion being orientated at a small angle with the direction of travel. It is the latter fibres which contribute to the transverse strength in the web.

In the present invention it is believed that when the air stream passing between the penultimate and last carding cylinders and flowing with the projected fibres meets with resistance due to the restricted outlet for the air between the penultimate carding cylinder and doffer at least a preponderance of the fibres are skewed so that on reaching the doffer and forming a web of fibres at the doffer they lie at a small acute angle to the general direction of longitudinal orientation of fibres in the web. These skewed fibres contribute to transverse strength in the web.

When the doffer is followed by one or more further doffers, on deceleration of the fibrous web between the doffers further pushing together of the fibres takes place and whose already lying at an acute angle to the direction of travel of the web are further disaligned at each transfer and in each case there is an increase in transverse strength of the web.

The fibrous web is removed from the doffer or further doffer as a coherent web by an oscillating comb or a doffer roller as convenient depending upon the direction of travel of the doffer or further doffer.

The strengths of the fibrous web in the longitudinal and transverse directions as referred to herein are not measurable in the web itself but become apparent and readily measurable when the web is converted into a non-woven fabric by impregnation with a suitable bonding agent.

The nature of the webs required determines the choice of the speed of the last carding cylinder, the differ and where appropriate the further doffers.

If a very high throughput of fibres is required to provide a high output weight then the last carding cylinder should be rotated at high surface speed but below the speed where there is a tendency for the cylinder to lose fibres too quickly to the doffer. Preferably the speed should not exceed about 1200 metres/minute at the surface of the cylinders. The doffer correspondingly should be rotated at a speed sufficient to prevent overloading of the last carding cylinder with fibres and similarly any further doffers should be rotated at such a rate that overloading of preceding doffers is avoided.

The card clothing on the fast rotating last carding cylinder must be such that it picks up fibres readily from the penultimate carding cylinder but releases the fibres easily by tangential force to the doffer. Similarly the card clothing of the doffer must be capable of holding the increased weight of fibres and where it is followed by one or more further doffers the density of wires in the card clothing of the doffers decreases from doffer to doffer towards the web delivery end of the machine in order to accommodate the increased load of fibres being processed.

If required, a possible overloading of the last carding cylinder with fibres which otherwise would fill up the cylinder and be thrown off as nap may be avoided by providing a second doffer in working relationship with the last carding cylinder but remote from the penultimate carding cylinder with means for rotating the second doffer at a peripheral speed less than the peripheral speed of the last carding cylinder. Further, at least one second further doffer may be placed in train in working relationship with the second doffer with means for rotating each second further doffer at a peripheral speed less than the peripheral speed of the preceding second doffer or second further doffer. The excess fibres are thus removed as a carded web from the second doffer or the last second further doffer in train.

The fibres processed by the carding machine in accordance with the invention may be natural or synthetic textile fibres or mixtures thereof in which the denier is preferably within the range between 1½ and 50 denier and the length within the range between 1 inch and 8 inches.

The webs produced in accordance with the invention may be impregnated with a bonding agent such as viscose followed by regeneration of the cellulose or a synthetic rubber latex or polyacrylate emulsion to form a non-woven fabric.

Figure 2:
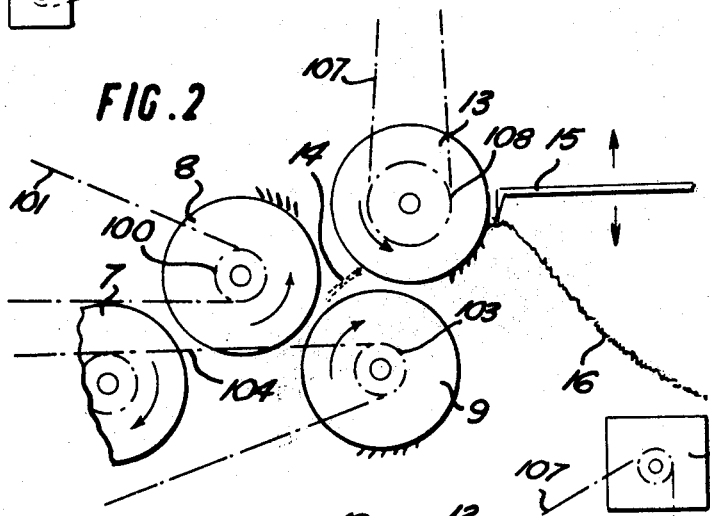
Figure 3:
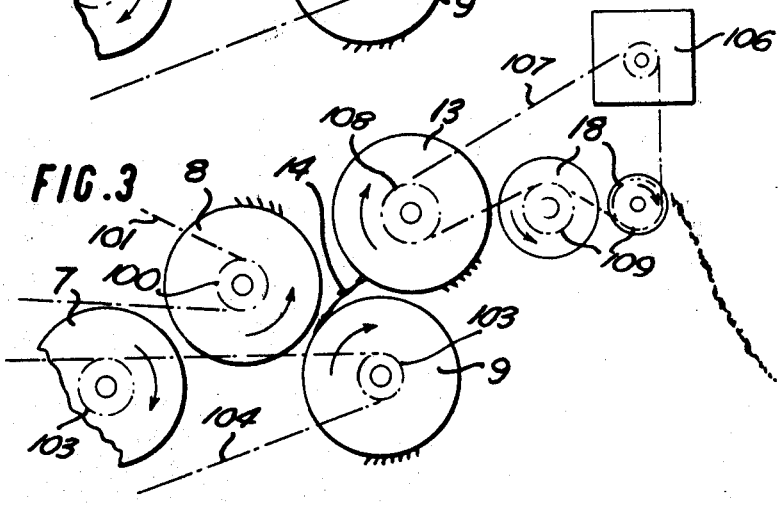
Figure 4:
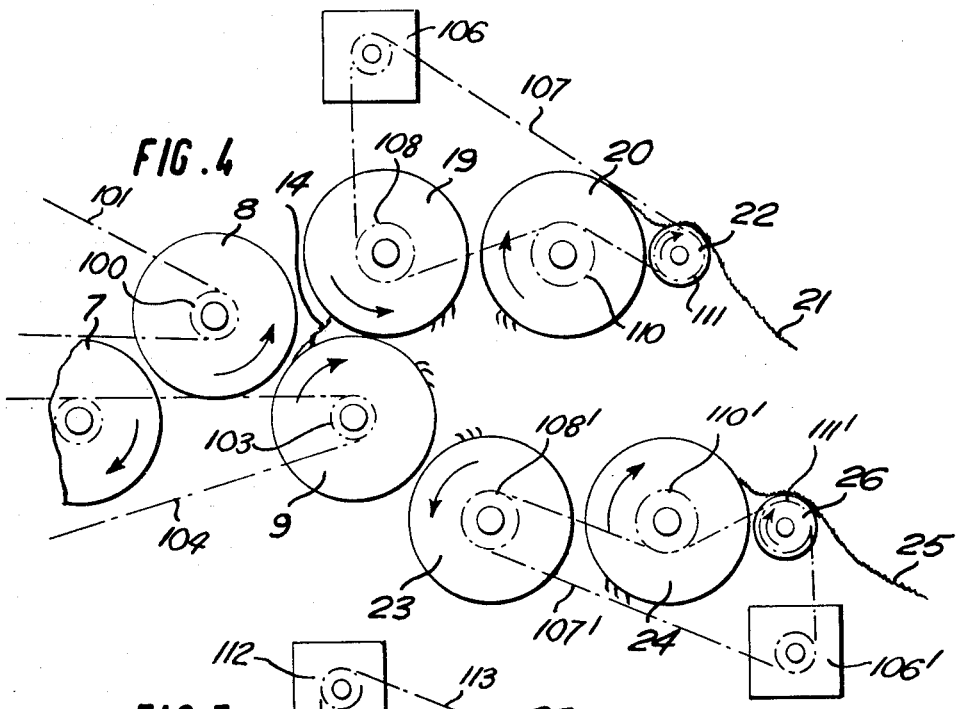
Figure 5:
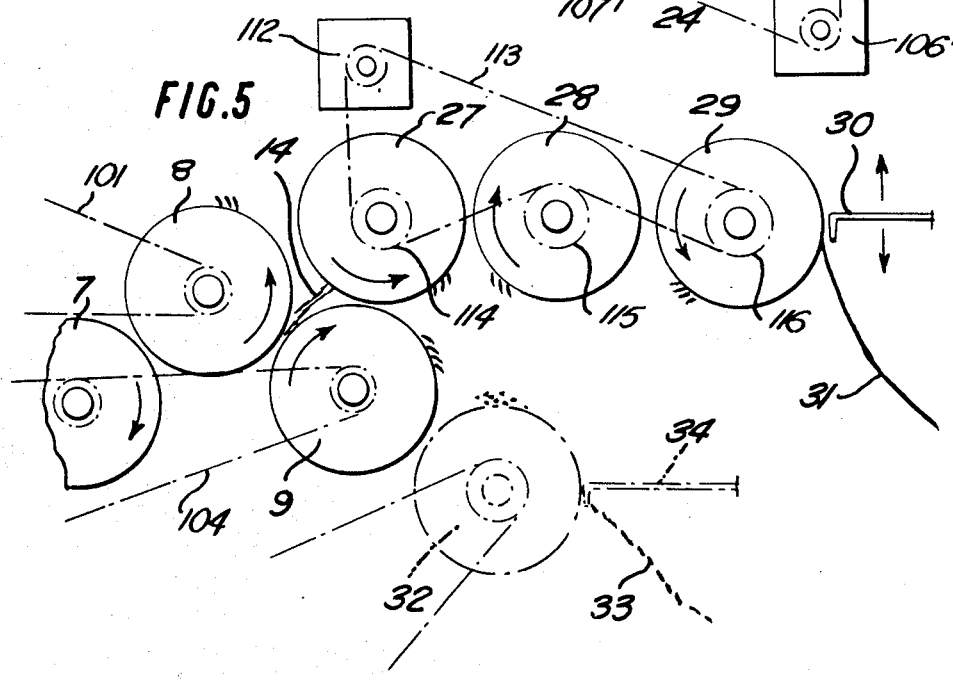
Figure 6:
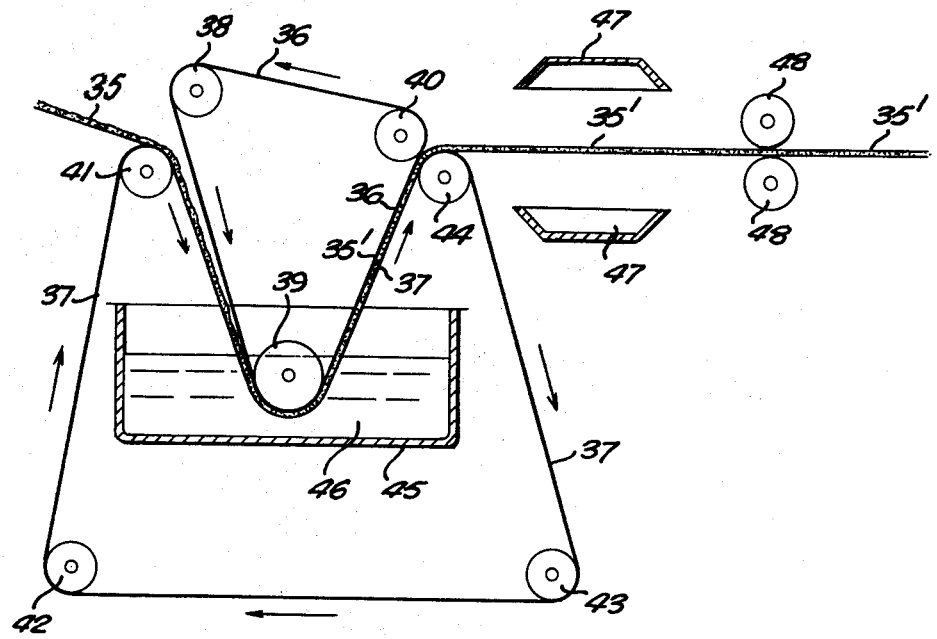

The invention will now be more specifically described, by way of example, with reference to the accompanying drawings, wherein FIG. 1 is a diagrammatic side elevation of a carding machine in accordance with the invention, FIG. 2 is an enlarged view of a part of FIG. 1, FIG. 3 is a modification of FIG. 2, FIG. 4 is an enlarged view similar to FIG. 2 but illustrating a further form of the invention FIG. 5 is an enlarged view similar to FIG. 4 but illustrating still a further form of the invention and FIG. 6 is a diagrammatic side elevation of a web impregnation apparatus.

In FIG. 1 a roller train carding machine comprises cylinders 1 to 9 of the same diameter, clothed with wire clothing and arranged in succession in working relationship. The cylinders 1 to 9 are rotated at progressively increased speeds along the train. To effect this, cylinders 2, 4, 6 and 8 are each provided with pinions 100 of decreasing size which are driven through a common driving chain 101 by a motor 102. Cyinders 3, 5, 7 and 9, which are rotated in an opposite direction to cylinders 2, 4, 6 and 8 are similarly provided with pinions 103 of decreasing size and are driven through a second common driving chain 104 by a second motor 105.

A lap or mat 10 of textile fibres is fed at the feed end of the machine to carding cylinder 1 by feeding means 11 and is progressively conveyed and processed from carding cylinder 1 to carding cylinder 9 in a known manner assisted by worker rollers 12 between pairs of carding cylinders 1 to 8. A doffer 13 rotated in direction (as shown) is placed in such a position that it is in working relationship with carding cylinder 9, for example at a distance of about between 5 and 12 thousandths of an inch between the wire clothing on each of the cylinders 9, 13, and is sufficiently close to the carding cylinder 8 that without being in fibre working relationship with it, there is a restriction on flow of air between the carding cylinder 8 and doffer 13. The ends of the cylinders 8, 9 and doffer 13 are protected by a close fitting casing at each end. The distance between the wire clothing on the carding cylinder 8 and the doffer 13 may conveniently be of the order of 30 thousandths of an inch. The doffer 13 is rotated at a much slower peripheral speed, for example 100 times less than the carding cylinder 9 by a motor 106 through a third driving chain 107 and pinion 108 provided on the shaft of doffer 13.

In this arrangement, as illustrated in FIG. 2, by virtue of the peripheral speed of the carding cylinder 9 fibres 14 projected by the cylinder 9 fly in a web-like form and are caught upon the clothing of the surface of the doffer 13 where they push up together due to the much slower peripheral speed.

The fibres 14 are then removed from the doffer 13 by means of an oscillating comb 15 in the form of a coherent web 16.

Since the space defined between the cylinders 8, 9 and doffer 13 is closely confined with the widest gap being between the cylinder 8 and the doffer 13, the air flow accompanying the fibres 14 projected from the cylinder 9 meets resistance due to the restriction offered to air flow by the gap between cylinder 8 and doffer 13. It is believed that this resistance has the effect of causing at least a proportion of the fibres 14 to be laid at the doffer at an angle different to that at which they would have been laid with a conventional cylinder doffer assembly.

When the web 16 is converted to a non-woven fabric, for example by impregnating with an acrylic latex followed by drying, it is found on measurement to have a significantly higher strength in the transverse direction than in the transverse direction of a similar non-woven fabric manufactured from a web on a roller train carding machine as described, but with the doffer 13 in its conventional place as shown by the dotted outline numbered 17 in FIG. 1.

It will be appreciated that the number of carding cylinders and worker rollers in the train is not critical and may be selected as appropriate. The purpose of the carding cylinders is to form on the last cylinder 9 a uniform web of fibres which are fully opened and substantially disentangled from each other. Thus a particular fibre or blend of fibres which is easy to open can be processed on a machine with fewer carding cylinders and worker rollers than a more difficult openable fibre or blend of fibres which would require a greater number of cylinders and working rollers.

In FIG. 3, the machine parts are as shown in FIG. 2 with the exception that the doffer 13 is reversed and rotated in a clock-wise direction and the comb 15 is replaced by a roller doffer assembly 18. In this arrangement the fibres 14 collected by the doffer 13 pass through the gap between the cylinder 8 and doffer 13 and thus avoid the further working between cylinder 9 and doffer 13 which has some combing and thus parallelising effect upon the web. Doffer assembly 18 is driven by driving chain 107 passing over pinions 109 on the members of assembly 18.

In a specific apparatus as shown in FIGS. 1 and 2 of the drawings, the carding cylinders 8, 9 had a diameter of 10 inches and were respectively rotated at a speed of 600 and 1000 revolutions per minute. The doffer 13 had a diameter of 10 inches and was rotated as described at a speed of 10 revolutions per minute.

In FIG. 4, a doffer 19 is mounted in working relationship with cylinder 9, for example at a distance of between about 5 and 12 thousandths of an inch between the wire clothing and a further doffer 20 is mounted in working relationship with doffer 19. Further, the doffer 19 is sufficiently close to the carding cylinder 8 that without its being in fibre working relationship with cylinder 8, there is a restriction to the flow of air between the cylinder 8 and the doffer 19. The distance between the wire clothing on the cylinder 8 and the doffer 19 may conveniently be of the order of 30 thousandths of an inch. The doffer 19 is rotated at a slower peripheral speed than the cylinder 9, for example, between 1:4 and 1:10 of the speed of cylinder 9 by means of motor 106, chain 107 and a pinion 110 provided on doffer 20. Fibres 14 flying from the carding cylinder 9 due to the peripheral speed of the cylinder 9 are caught on the clothing of the doffer 19 and the web so formed is then worked on to the second doffer 20 which is rotated at a much slower peripheral speed than the doffer 19, for example between 1:4 and 1:10 of the speed of doffer 19 through chain 107 and pinion 108.

The difference in speeds between the cylinder 9 and the doffer 19 results in some pushing up of the fibres 14 on arrival at the doffer 19 when a proportion of the fibres 14 are skewed at a small acute angle to the general direction of the fibres 14. When the web formed on the doffer 19 passes to the slower rotating further doffer 20 there is again a pushing up of the fibres 14 when the fibres 14 lying at a small angle to the direction of travel of the web are caused to turn still further away from the direction of travel of the web.

The fibres 14 are finally removed from the doffer 20 in the form of a coherent web 21 by a fluted stripper roller 22 driven by chain 107 through a pinion 111.

The nature of the webs required determines the choice of the speeds of the last carding cylinder 9 and the doffers 19, 20.

If a very high throughput of fibres 14 is required to provide a high output weight then the last carding cylinder 9 should be rotated at high speed but below the surface speed where there is a tendency for the cylinder 9 to lose fibres too quickly to the doffer 19. Preferably, this speed should not exceed about 1200 metres/minute at the surface of the cylinder 9. The doffer 19 correspondingly should be rotated at a speed sufficient to prevent overloading of the last carding cylinder with fibres. The peripheral speed of the doffer 19 should be about 1:4 of the peripheral speed of the last carding cylinder 9. Similarly, the further doffer 20 should be rotated to provide a peripheral speed of about 1:4 of the peripheral speed of the doffer 19.

If a web of particularly high quality of uniformity, fine opening and maximum transverse strength is required, then the last carding cylinder 9 should be rotated at a speed much lower than for the web of high output, for example at between about 300 and 600 metres/minute at the surface and the doffer 19 should be rotated at a peripheral speed of about 1:10 the speed of the last carding cylinder 9. Similarly, the further doffer 20 is rotated to provide a peripheral speed of 1:10 the speed of the doffer 19.

To prevent an overloading of fibres 14 on the carding cylinder 9 a second doffer 23 and a second further doffer 24 working with doffer 23 are arranged to remove excess fibres 14 which collect on cylinder 9. Doffers 23 and 24 are driven by a motor 106' through a chain 107' and pinion 108', 110'. The fibres 14 from the cylinder 9 are picked up by the doffer 23 which is rotated at a speed slower than that of the cylinder 9 and corresponding with the speed of cylinder 10. From the doffer 23 the fibres 14 pass to the doffer 24 which in turn is rotated at a speed slower than that of the cylinder 23 and corresponding with the speed of the cylinder 20. Because of the speed difference the fibres 14, generally orientated in the direction of travel, are pushed up together. The fibres 14 in web form are finally removed from the cylinder 24 as a coherent web 25 by a second fluted stripper roller 26 driven by chain 107' through a pinion 111'.

In a specific apparatus as shown in FIG. 4 the carding cylinders 8, 9 had a diameter of 10 inches and were rotated at a speed of 600 and 1000 revolutions per minute respectively. The doffers 19, 20, 23 and 24 also had a diameter of 10 inches, but the doffers 19 and 23 were each rotated at 70 revolutions per minute and the doffers 20 and 24 were each rotated at 10 revolutions per minute.

The machine was fed with a lap of 3 denier 38 mm. nylon fibres having 8 crimps per cm. and the webs 23 and 25 produced as described were each, separately, impregnated with a conventional polyacrylate emulsion bonding agent and dried to produce non-woven fabrics. The non-woven fabric formed from the web 21 was found to have a transverse strength of about 40% the value of the strength in the longitudinal direction and the non-woven fabric formed from the web 25 was found to have a transverse strength of about 25% the value of the strength in the longitudinal direction.

In FIG. 5 a doffer 27 with two associated further doffers 28 and 29 is mounted in working relationship with cylinder 9 for example at a distance of between about 5 and 12 thousandths of an inch between the wire clothing. Further, the doffer 27 is sufficiently close to the penultimate carding cylinder 8, for example about 30 thousandths of an inch between the wire clothing, that without its being in fibre working relationship with cylinder 8, there is a restriction to the flow of air between the cylinder 8 and the doffer 27. The doffer 27 is rotated at a slower peripheral speed than the cylinder 9, for example between 1:12 and 1:4 of the speed of cylinder 9, by means of a motor 112 through a chain 113 and a pinion 114.

Fibres 14 flying from the carding cylinder 9 due to the peripheral speed of the cylinder and assisted by the air turbulence set up in the space between cylinders 8, 9 and doffer 27 are caught upon the clothing of the doffer 27 and the web so formed is then worked on to the further doffer 28 which is rotated at a much slower peripheral speed than the doffer 27, for example between 1:7 and 1:3 the speed of the doffer 27. Fibres 14 collected by the doffer 28 are then worked on to the further doffer 29 which is rotated at a much slower peripheral speed than the doffer 28, for example between 1:3 and 1:1.4 of the speed of doffer 28. Doffers 28 and 29 are driven by motor 112 through chain 113 and pinions 115, 116.

The fibres 14 are finally removed from the doffer 29 in the form of a coherent web 31 by an oscillating comb 30.

In circumstances where it is found to be desirable to prevent the overload of cylinder 9 with fibres 14 a second doffer with or without further doffers (as described with reference to FIG. 4) indicated in outline at 32 may be provided to take off the excess fibres 14 which are then removed from the second doffer or last second further doffer 32 as a web 33 by, for example, an oscillating comb 34.

In a specific apparatus, the carding cylinders 8, 9 each had a diameter of 10 inches and were rotated at a speed of 600 and 1000 revolutions per minute respectively. The doffers 27, 28 and 29 similarly each had a diameter of 10 inches and were rotated at a speed of 90, 18 and 12 revolutions per minute respectively. The machine was fed with a lap of 3 denier 38 mm. nylon fibres having 8 crimps per cm. and the web 31 so produced was uniformly impregnated with a polyacrylate emulsion bonding agent and dried to produce a non-woven fabric. The fabric had a transverse strength about 70% of the value of the strength in the longitudinal direction.

It will be seen that fibres 14 which have been brought progressively to a high speed of travel to the last carding cylinder 9 are brought to rest in a web, not abruptly, but progressively in stages from doffer to doffer. At the first stage, between the last carding cylinder and the first doffer, some disalignment of some of the fibres from the general orientation in the direction of travel occurs. In the subsequent stages of deceleration between the doffer 27 and doffer 28 and the doffer 28 and doffer 29 this disalignment of some of the fibres is gently accentuated as the fibres are further pushed together, leading, subsequently, to a web having enhanced transverse strength. This strength becomes apparent in a non-woven fabric formed from the web.

The webs from two or more carding machines n accordance with the invention may be combined in parallel or cross-laid relationship to form a single composite web.

The initially formed web or the composite web may be impregnated with a bonding agent, for example viscose followed by regeneration of cellulose or by an acrylic latex to form a non-woven fabric.

In a specific example as shown in FIG. 6, a web 35, as produced in accordance with the invention, is led between two continuous flexible screens 36, 37 each moving in the direction shown by the arrows around driven rollers 38, 39, 40 and 41, 42, 43, 44 and 39 respectively. The common roller 39 is immersed in a container 45 containing an acrylic latex bonding agent 46 and here, the web 35 held firmly between the screens 36, 37 is completely impregnated with the agent 46. The impregnated web 35' is then led between rollers 40, 44, the nip of which is adjustable to ensure that excess agent 46 carried by the web 35' is squeezed out and returned to the container 45. The impregnated web 35' is then drawn through an infrared dryer 47 by nip rollers 48 where the bonding agent 46 is dried and cured as required.

I claim:

1. A carding machine for forming a fibrous web from textile fibres comprising at least three carding cylinders arranged in succession, worker means associated with the carding cylinders for working fibres progressively from cylinder to cylinder, means for rotating the cylinders at successively increasing peripheral speeds in the direction of travel of the fibres and for rotating each successive cylinder in an opposite direction to the preceding cylinder, a doffer in working relationship with the last cylinder for receiving the fibres, means for rotating the doffer at a peripheral speed less than the peripheral speed of the last carding cylinder, and means for removing the fibres from the doffer in the form of a fibrous web, the doffer being mounted with its peripheral surface spaced from the peripheral surface of the penultimate carding cylinder by a distance between 0.017 and 0.50 inches to receive fibres projected from the last carding cylinder to the doffer through a confined space defined between the doffer, the pneultimate carding cylinder and the last carding cylinder.

2. A carding machine as claimed in claim 1 in which the peripheral surface of the doffer and peripheral surface of the penultimate carding cylinder are spaced by a distance of between 0.02 to 0.20 inches.

3. A carding machine as claimed in claim 1 in which at least one further doffer is placed in train in working relationship with the doffer with means for rotating the at least one further doffer at a peripheral speed less than the adjacent preceding doffer.

4. A process for forming a fibrous web comprising feeding textile fibres to the feed end of a carding machine including at least three carding cylinders arranged in succession and rotated at incrementally increased peripheral speeds and successively in oposite directions, working the fibres from carding cylinder to carding cylinder towards a web delivery end of the machine, rotating the last carding cylinder at such a peripheral speed that fibres carried by it are projected to a doffer, rotating the doffer at a peripheral speed less than the peripheral speed of the last carding cylinder, maintaining the doffer in a position with its peripheral surface spaced from the peripheral surface of the penultimate carding cylinder by a distance between 0.017 and 0.50 inches so as to define a confined space between the doffer, the penultimate carding cylinder and the last carding cylinder through which the fibres are projected between the last carding cylinder and the doffer, and removing the fibres from the doffer in the form of a fibrous web.

5. A process as claimed in claim 4, comprising the further step of impregnating the fibrous web with a bonding agent to produce a non-woven fabric.

6. A process as claimed in claim 5 in which the bonding agent is an acrylic latex.

7. A process as claimed in claim 4 in which the doffer is maintained in a position with its peripheral surface spaced from the peripheral surface of the penultimate carding cylinder by a distance between 0.02 and 0.20 inches.

8. A process as claimed in claim 4 in which the fibres received by the doffer are transferred to at least one further doffer in train, the at least one further doffer being rotated at a peripheral speed less than the adjacent preceding doffer.

* * * * *